United States Patent [19]

Minasov et al.

[11] 4,282,069

[45] Aug. 4, 1981

[54] COKE DRY QUENCHING APPARATUS

[76] Inventors: Alexandr N. Minasov, ulitsa Ivanova, 12/16. kv. 59; Evgeny P. Likhogub, ulitsa Slinko, 2, kv. 11; Vasily S. Kononenko, prospekt 50-letia SSSR, 12, kv. 81, all of Kharkov, U.S.S.R.

[21] Appl. No.: 171,164

[22] Filed: Jul. 22, 1980

[51] Int. Cl.[3] ..... C10B 39/02

[52] U.S. Cl. ..... 202/228; 201/39

[58] Field of Search ..... 201/39; 202/228

[56] References Cited

U.S. PATENT DOCUMENTS

| | | | |
|---|---|---|---|
| 3,895,448 | 7/1975 | Jonnet | 202/228 X |
| 3,959,084 | 5/1976 | Price | 202/228 X |
| 4,211,607 | 7/1980 | Privalov et al. | 201/39 |

FOREIGN PATENT DOCUMENTS

| | | | |
|---|---|---|---|
| 494511 | 2/1976 | Australia | 202/228 |
| 1061412 | 3/1967 | United Kingdom | 202/228 |
| 1433575 | 4/1976 | United Kingdom . | |

*Primary Examiner*—Frank W. Lutter
*Assistant Examiner*—Roger F. Phillips
*Attorney, Agent, or Firm*—Fleit & Jacobson

[57] ABSTRACT

A coke dry quenching apparatus comprises a vertical chamber in the lower portion of which is disposed a quenching gas feeding means. The chamber has in its roof a charging hole and in its bottom a discharging gate. In the walls of the chamber is disposed a plurality of peripheral gas conduits communicated with the inner space of the chamber and with an annular collector having a common gas withdrawal conduit. According to the invention the hollow of the collector is divided by a horizontal partition provided with ports into two cavities communicating with one another, the lower cavity being communicated with the peripheral gas conduits and the upper one with the common gas withdrawal conduit.

Due to the fact that the pressure of quenching gas in the lower cavity of the collector is equalized, the proposed apparatus ensures that the quenching gas flow rate through all the peripheral gas withdrawal conduits is practically equal, which provides for a uniform cooling of the whole mass of the coke being treated. This permits the consumption of quenching gas to be reduced, and the efficiency of the process to be raised.

4 Claims, 3 Drawing Figures

COKE DRY QUENCHING APPARATUS

BACKGROUND OF THE INVENTION

1. Field of the Invention

The present invention relates to coke production facilities, and more specifically to coke dry quenching chambers. Most efficiently the invention can be used in the coke chemical-recovery industry.

Although the method of coke dry quenching has been known since the beginning of the last century, the attempts to improve apparatuses for carrying out this method have not been ceased until present. These attempts were aimed mainly at upgrading the quality of coke and raising the efficiency of the quenching process. A relatively great number of patents granted for improvements in such apparatus in recent years in a number of countries indicates that this problem remains an urgent one.

2. Prior Art

There is known an apparatus for dry coke quenching (cf. U.S. Pat. No. 3,959,084), incorporated in a two-chamber quenching installation. This apparatus comprises a vertical chamber having a charging hole in its roof and a discharging gate in the bottom. In the lower portion of the chamber is disposed a means for feeding quenching gas. A branch pipe to let a hot gas out is fixed to one of the walls of the chamber in the upper portion thereof.

Adjacent to the discharging gate is a chamber for cooling the coke with water. The presence of this cooling chamber is caused by the necessity to equalize temperature through the whole mass of the coke being treated, which is not achieved by using only dry quenching. This is due to the fact that the amount of quenching gas passing through the coke disposed close to the outlet branch pipe is greater than that of the gas passing through the coke in zones remote therefrom.

Though the resulting coke produced at this quenching installation possesses anisotropic properties, operating the said quenching installation is associated with a number of disadvantages inherent in all the known methods of wet quenching.

It is a matter of common knowledge that the thermal stresses occurring in the coke in the case of using wet quenching causes cracks in the coke lumps and hence fragmentation thereof, which fragmentation is favoured by the water getting inside these cracks and rapidly evaporating therein. As a result, the coke thus produced contains a great number of small fractions which cannot but affect the operation of a blast furnace.

Another undesirable phenomenon occurring in the case of the wet quenching process is the formation of hydrogen sulfide and sulfurous anhydride, which escape together with water vapor into the atmosphere.

The above disadvantage has been overcome in a coke one-stage dry quenching apparatus (cf. British Pat. No. 1,433,575) which comprises a vertical chamber having in its roof a charging hole, in its bottom a discharging gate, and within its walls gas exhaust conduits, and a annular collector having a common outlet pipe. The gas exhaust conduits communicate the inner space of the chamber with the annular collector. In the lower portion of the chamber is disposed a means for feeding a quenching gas.

This coke quenching apparatus is free from disadvantages associated with wet quenching applied at the second stage of quenching in the aforesaid apparatus. In addition, removal of quenching gas from the quenching chamber through a plurality of peripheral gas exhaust conduits makes it possible to equalize to some extent the coke cooling conditions.

It has been established, however, that the amount of the quenching gas passing through the peripheral gas conduits disposed close to the common gas withdrawal conduit than through the peripheral gas conduits remote therefrom, which is due to the fact that the pressure in the collector is minimal in the zone close to the common gas withdrawal conduit and increases with the increase of a distance therefrom, which is responsible for that a portion of the coke being treated is not sufficiently cooled. To remedy this, more quenching gas is blown, thereby affecting the efficiency of the process.

It is clear, that this disadvantage could be removed by means of a proportioned removal of gas from each individual peripheral conduit through an individual vacuum pump. This, however, is not advisable, since a relatively great number of the peripheral gas conduits (15–30) would involve a more complex construction.

SUMMARY OF THE INVENTION

The principal object of the invention is to provide an apparatus ensuring a uniform dry quenching of the whole mass of the coke being treated.

Another not less important object of the invention is to raise the quality of coke produced by dry quenching.

Still another object of the invention is to provide a coke dry quenching apparatus ensuring an equal flow rate of quenching gas through each of the peripheral gas conduits without considerable complication of its construction.

Yet another object of the invention is to improve the efficiency of coke dry quenching.

These and other objects of the invention are accomplished by that in a coke dry quenching apparatus comprising a vertical chamber having in its roof a charging hole, in its bottom a discharging gate, and in its walls a plurality of gas withdrawal conduits communicating the inner space of the chamber, through an annular collector, with a common gas withdrawal conduit, and a quenching gas feeding means, according to the invention, within the annular collector is installed a horizontal partition to divide the hollow thereof into a lower cavity communicated with the peripheral gas withdrawal conduits, and an upper cavity communicated with the common gas withdrawal conduit, and which partition having ports communicating the upper cavity of the collector with its lower one.

Such construction of the apparatus prevents a local pressure drop at the peripheral gas conduits located close to the common gas withdrawal conduit, which is prevented, in particular, by the horizontal partition installed within the annular collector. In spite of the fact that in the upper cavity of the collector there occur a considerable pressure gradient between the different sections thereof, the pressure in the lower cavity is considerably equalized, which ensures that the amount of gas passing through each of the peripheral conduits is practically equal, and thus permits the whole mass of coke to be uniformly cooled. This in turn, enables the consumption of the quenching gas to be reduced, and the efficiency of the coke dry quenching process to be improved.

It is expedient that the lower cavity of the collector be divided by vertical partitions along the axial plane of the common gas withdrawal conduit into two semicircular sections each being communicated through a port with the upper cavity of the collector. Such arrangement will rule out occurence of a circular flow of gas in the lower cavity of the collector and an undesirable pressure variation.

The best result is achieved when the ports communicating the sections of the lower cavity of the collector with the upper cavity thereof are located in the opposite portions of the horizontal partition at an equal distance from the common gas withdrawal conduit.

It is also advisable that the upper cavity of the collector be divided in the same way into two semicircular sections by vertical partitions, one of which being so installed that the inlet opening of the common gas withdrawal conduit is halved thereby. This on the one hand will rule out circular motion of gas in the upper cavity of the collector, and on the other will strengthen that portion of the wall which is adjacent to the common gas withdrawal conduit.

BRIEF DESCRIPTION OF THE DRAWING

The invention will now be explained in greater detail with reference to embodiment thereof taken in conjunction with the accompaning drawings, wherein:

Referring now to FIG. 1, an apparatus for coke dry quenching comprises a vertical chamber 1, and a quenching gas feeding means 2. The vertical chamber 1 has a roof 3, a bottom 4, and walls 5. In the roof 3 there is provided a charging hole 6 with a cover 7. A discharging gate 8 is disposed in the bottom 4. The walls 5 of the chamber 1 are built from refractory bricks. Disposed in the said walls 5 of the chamber 1 are a plurality of peripheral gas conduits 9, an annular collector 10, and a common gas withdrawal conduit 11. The peripheral gas conduits 9 are arranged in one level and are uniformly spaced relative one another along the perimeter of the chamber 1 horizontal section.

Figure 1:
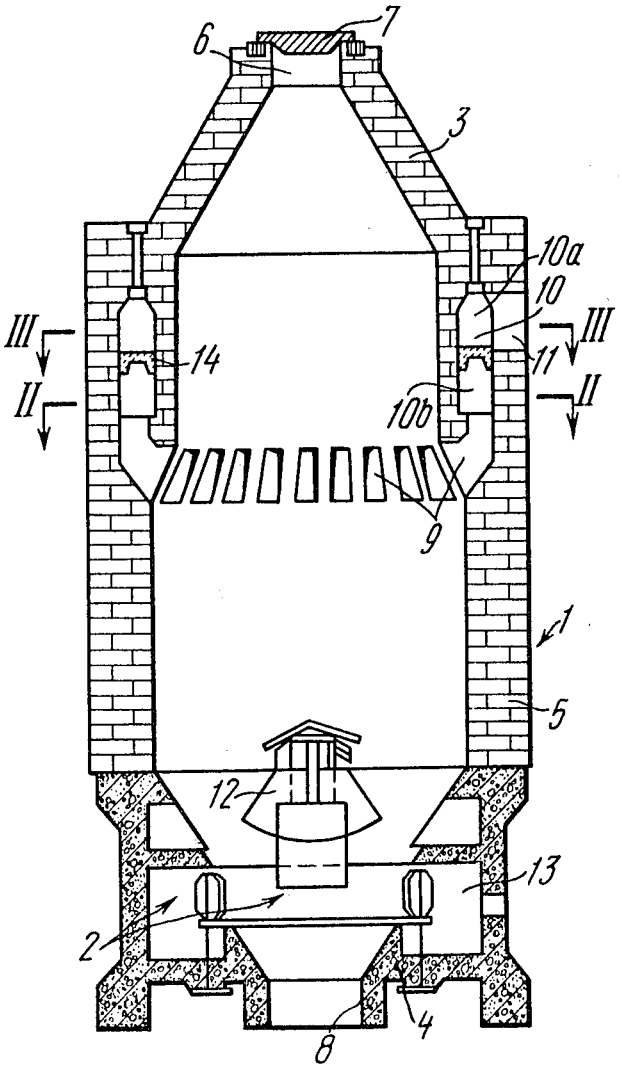
FIG. 1 represents an axial section of the coke dry quenching apparatus of the invention.

The gas conduits 9 are formed inclined and intended for communicating the inner space of the chamber 1 with the collector 10 connected with the common gas withdrawal conduit 11. Connected to the common gas withdrawal conduit 11 is a recirculation gas cooling system having an exhaust fan and a heat exchanger (not shown).

The quenching gas feeding means 2 is located in the lower portion of the chamber 1, and includes a distributor 12 and a system of cavities 13 communicated with the said recirculation gas cooling system (not shown).

Figure 2:
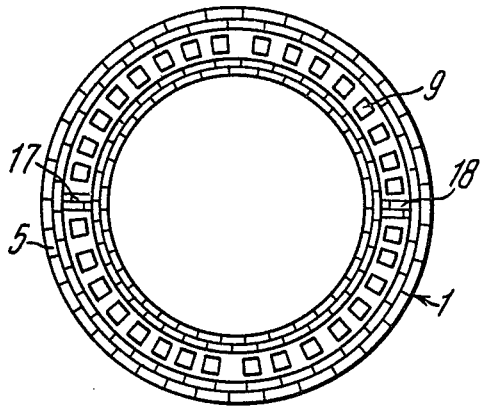
FIG. 2 shows a modification of the apparatus of the invention, cross section along line II—II in FIG. 1.

According to the invention within the collector 10 there is installed a horizontal partition 14 dividing the hollow thereof into an upper cavity 10*a*, and a lower cavity 10*b*. The lower cavity 10*b* is communicated with the peripheral gas conduits 9, as can be seen in FIGS. 1, 2. The upper cavity 10*a* communicates with the common gas withdrawal conduit 11.

The horizontal partition 14 has ports 15 and 16 (FIG. 3) communicating the lower cavity 10*b* with the upper cavity 10*a* of the collector. The ports 15 and 16 are identical, and their number is arbitrary.

In the preferred embodiment of the invention the lower cavity of the collector 10 is divided by vertical partitions 17 and 18 into two semicircular sections (FIG. 2). The vertical partitions 17 and 18 are oriented along the axial plane of the common gas withdrawal conduit 11. One of the semicircular sections communicates with the upper cavity 10*a* through the port 15, and the other through the port 16.

Figure 3:
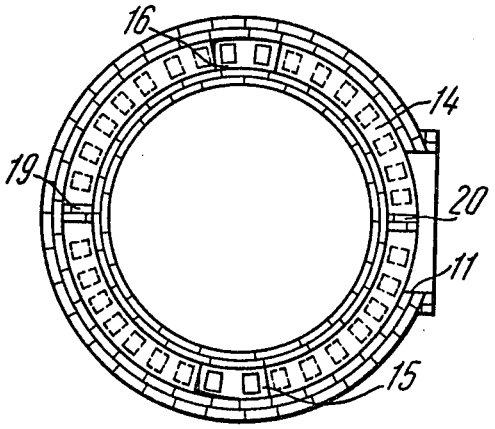
FIG. 3 represents a sectional view of the apparatus of the invention, along line III—III in FIG. 1.

It is expedient that the upper cavity 10*a* of the collector be also divided by vertical partitions 19 and 20 into two semicircular sections in the same way as in the case of the lower cavity 10*b* (FIG. 3).

The ports 15 and 16 are disposed in opposite portions of the horizontal partition 14 at an equal distance from the common gas withdrawal conduit 11.

The vertical partitions 19 and 20 are oriented along the axial plane of the common gas withdrawal conduit 11, with the partition 20 dividing the inlet opening of the common gas withdrawal conduit 11 in two.

The apparatus of the invention operates as follows. Incandescent coke is charged in batches through the charging hole 6 so that the upper level of the coke within the chamber 1 is maintained higher than the level of the peripheral gas conduits 9. A quenching gas through the system of cavities 13 and the distributor 12 uniformly flows through the whole cross section of the chamber 1. Within the chamber 1, between its upper and lower zones there is produced a pressure gradient, which is achieved by that the quenching gas is forced into the lower zone and forced out from the upper one. Passing through the mass of incandescent coke the quenching gas cools the latter and through the peripheral gas conduits 9 is passed into the lower cavity 10*b* of the annular collector 10. Owing to the presence of the horizontal partition 14, the pressure within the lower cavity 10*b* of the collector is maintained uniform through the whole volume thereof which provides for an equal flow rate of quenching gas through each of the gas conduits. From the lower cavity 10*b* the hot gas through the ports 15 and 16 is passed into the upper cavity 10*a* and therefrom into the common gas withdrawal conduit 11. The partitions 17 and 18, as well as 19 and 20 prevent gas circulation in the upper and lower cavities 10*a* and 10*b*, thereby ruling out pressure variation. A uniform withdrawal of the heated gas along the whole perimeter of the chamber 1 cross section favours a uniform cooling of the whole mass of the coke being treated. From the common gas withdrawal conduit the heated quenching gas is exhausted by the suction fan, is purified, cooled in the heat exchanger and through the recirculation system distributor 12 and the system of cavities 13 is passed again into the chamber 1. The heat of incandescent coke being cooled is utilized in the heat exchanger.

As compared with the prior art apparatus, the apparatus of the present invention ensures a more uniform cooling of coke, reduces consumption of quenching gas, and improves the efficiency of the process. In addition, the apparatus of the invention provides for that the temperature of the quenching gas heated by incandescent coke is maintained constant, thereby ensuring stable conditions for producing steam in the steam boilers.

While particular embodiments of the invention have been shown and described, various modifications thereof will be apparent to those skilled in the art and therefore it is not intended that the invention be limited to the disclosed embodiments or to the details thereof and the departures may be made therefrom within the spirit and scope of the invention as defined in the claims.

What we claim is:

1. A coke dry quenching apparatus comprising:

(a) a vertical chamber having
a roof with a charging hole;
a bottom with a discharging gate;
walls in which are disposed an annular collector with a common gas withdrawal conduit, and a plurality of gas peripheral conduits communicating the inner space of the chamber with said annular collector;
a horizontal partition having ports and being installed within said annular collector so that the hollow thereof is divided into a lower cavity communicated with said gas peripheral conduits, and an upper cavity communicated with said common gas withdrawal conduit; and (b) a quenching gas feeding means disposed in the lower portion of said chamber.

2. An apparatus as claimed in claim 1, wherein the lower cavity of said collector is divided along the axial plane of said common gas withdrawal conduit by vertical partitions into two semicircular sections, each of which sections being communicated through a port with the upper cavity of said collector.

3. An apparatus as claimed in claim 2, wherein said ports communicating said sections of said lower cavity of said collector with the upper cavity thereof are disposed in the opposite parts of said horizontal partition at an equal distance from said common gas withdrawal conduit.

4. An apparatus as claimed in claim 3, wherein the upper cavity of said collector is divided by vertical partitions in the same way as the lower one into two semicircular sections, one of which partitions being installed so that the inlet opening of said common gas withdrawal conduit is divided in two.

* * * * *